US011396109B2

(12) United States Patent
Omori et al.

(10) Patent No.: US 11,396,109 B2
(45) Date of Patent: Jul. 26, 2022

(54) PROCESSING APPARATUS

(71) Applicant: DISCO CORPORATION, Tokyo (JP)

(72) Inventors: Takafumi Omori, Tokyo (JP); Shigenori Harada, Tokyo (JP); Takashi Okamura, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 290 days.

(21) Appl. No.: 16/807,915

(22) Filed: Mar. 3, 2020

(65) Prior Publication Data

US 2020/0307010 A1 Oct. 1, 2020

(30) Foreign Application Priority Data

Mar. 25, 2019 (JP) ..... JP2019-057181

(51) Int. Cl.

| | |
|---|---|
| ***B26D 5/00*** | (2006.01) |
| ***B26D 1/04*** | (2006.01) |
| ***B26D 3/06*** | (2006.01) |
| *B26D 1/00* | (2006.01) |

(52) U.S. Cl.

CPC ..... *B26D 5/007* (2013.01); *B26D 1/04* (2013.01); *B26D 3/06* (2013.01); *B26D 2001/0046* (2013.01); *B26D 2001/0053* (2013.01); *B26D 2001/0093* (2013.01)

(58) Field of Classification Search

CPC ..... B26D 5/005; B26D 5/007

See application file for complete search history.

(56) References Cited

U.S. PATENT DOCUMENTS

2007/0028734 A1* 2/2007 Sekiya ..... B26D 5/007 83/72

FOREIGN PATENT DOCUMENTS

JP 11214334 A 8/1999

* cited by examiner

*Primary Examiner* — Jennifer S Matthews

(74) *Attorney, Agent, or Firm* — Greer Burns & Crain, Ltd.

(57) ABSTRACT

A processing apparatus includes a cutting blade mounted on a spindle, the cutting blade having a cutting edge for cutting a workpiece held on a holding table, a measuring portion for measuring an edge projection amount of the cutting edge at a predetermined frequency, and a data processing portion. The data processing portion includes a lower limit recording portion for recording a lower limit of the edge projection amount of the cutting edge as an allowable limit for use of the cutting blade, a storing portion for storing blade information including the edge projection amount measured by the measuring portion and a cutting distance traveled by the cutting blade at the time of measurement of the edge projection amount.

4 Claims, 9 Drawing Sheets

FIG.5

| BLADE ID | LOWER LIMIT OF EDGE PROJECTION AMOUNT(mm) |
|---|---|
| B001 | $t_z$ |
| ... | ... |

FIG.6

| MEASURED VALUE FOR EDGE PROJECTION AMOUNT(mm) | CUTTING DISTANCE(cm) |
|---|---|
| t1 | L1 |
| t2 | L2 |
| t3 | L3 |
| ... | ... |

PROCESSING APPARATUS

BACKGROUND OF THE INVENTION

Field of the Invention

The present invention relates to a processing apparatus.

Description of the Related Art

A cutting apparatus is known as a processing apparatus for cutting a workpiece such as a semiconductor wafer, an optical device wafer, and a package substrate along division lines. The cutting apparatus includes a chuck table for holding the workpiece and a cutting blade for cutting the workpiece held on the chuck table. The cutting blade wears with the use in cutting the workpiece. When the cutting blade wears, the workpiece cannot be cut to a desired depth. That is, the workpiece cannot be properly cut by this cutting blade worn. To cope with this problem, it is considered to detect the edge position of the cutting blade and then increase the depth of cut by an amount of wearing of the cutting blade according to the edge position detected. Under the circumstances, there has been proposed a technique of detecting the edge position of the cutting blade at a predetermined frequency.

Further, the cutting apparatus is designed so that when the edge projection amount of the cutting blade as the width of a cutting area of the cutting blade becomes less than the required depth of cut, an operator is informed of this condition and then prompted to exchange the cutting blade.

SUMMARY OF THE INVENTION

In performing an operation by using the cutting apparatus, there is an operator's desire such that the operator can grasp the timing of exchange of the cutting blade in advance to thereby efficiently perform the operation.

It is therefore an object of the present invention to provide a processing apparatus which can inform the operator of a guide for the timing of exchange of the cutting blade in advance.

In accordance with an aspect of the present invention, there is provided a processing apparatus including: a holding table for holding a workpiece; a spindle adapted to be rotated; a cutting blade mounted on the spindle, the cutting blade having a cutting edge for cutting the workpiece held on the holding table; measuring means for measuring an edge projection amount of the cutting edge at a predetermined frequency; and a data processing portion. The data processing portion includes: a lower limit recording portion for recording a lower limit of the edge projection amount of the cutting edge as an allowable limit for use of the cutting blade; a storing portion for storing blade information including the edge projection amount measured by the measuring means and a cutting distance traveled by the cutting blade at the time of measurement of the edge projection amount, the edge projection amount and the cutting distance being stored in a one-to-one correspondence manner; an inclination calculating portion for calculating an inclination such that the edge projection amount decreases with an increase in the cutting distance, from a plurality of pieces of the blade information stored in the storing portion by performing two or more measurements using the measuring means; and a predicting portion for calculating a maximum cutting distance corresponding to the lower limit of the edge projection amount from the inclination calculated by the inclination calculating portion.

With this configuration, the maximum cutting distance to be traveled by the cutting blade can be predicted and the operator can be informed of a guide for the timing of exchange of the cutting blade in advance. Accordingly, the workability of the operator can be improved.

Preferably, the inclination calculating portion performs recalculation of the inclination every time the measuring means measures the edge projection amount of the cutting blade. With this configuration, it is possible to improve the accuracy of calculation of the maximum cutting distance to be traveled by the cutting blade.

Preferably, the data processing portion further includes a time calculating portion for calculating the time required for cutting of the workpiece by a predetermined distance to be traveled by the cutting blade, from cutting conditions and the size of the workpiece. With this configuration, it is possible to calculate the time period until the maximum cutting distance to be traveled by the cutting blade is reached.

Preferably, the processing apparatus further includes displaying means for displaying blade exchange information as the timing of exchange of the cutting blade. The blade exchange information includes at least one of the cutting distance until the maximum cutting distance is reached, the time period until the maximum cutting distance is reached, the time when the maximum cutting distance is reached, and the number of workpieces that can be cut until the maximum cutting distance is reached. With this configuration, various kinds of information as a guide for the timing of exchange of the cutting blade can be provided to the operator.

According to the present invention, it is possible to exhibit an effect that the operator can be informed of a guide for the timing of exchange of the cutting blade in advance.

The above and other objects, features, and advantages of the present invention and the manner of realizing them will become more apparent, and the invention itself will best be understood from a study of the following description and appended claims with reference to the attached drawings showing a preferred embodiment of the invention.

BRIEF DESCRIPTION OF THE DRAWINGS

FIG. 5 is a table depicting an example of the lower limit of the edge projection amount of the cutting blade according to the preferred embodiment;

FIG. 6 is a table depicting an example of blade information according to the preferred embodiment;

DETAILED DESCRIPTION OF THE PREFERRED EMBODIMENT

Figure 1:
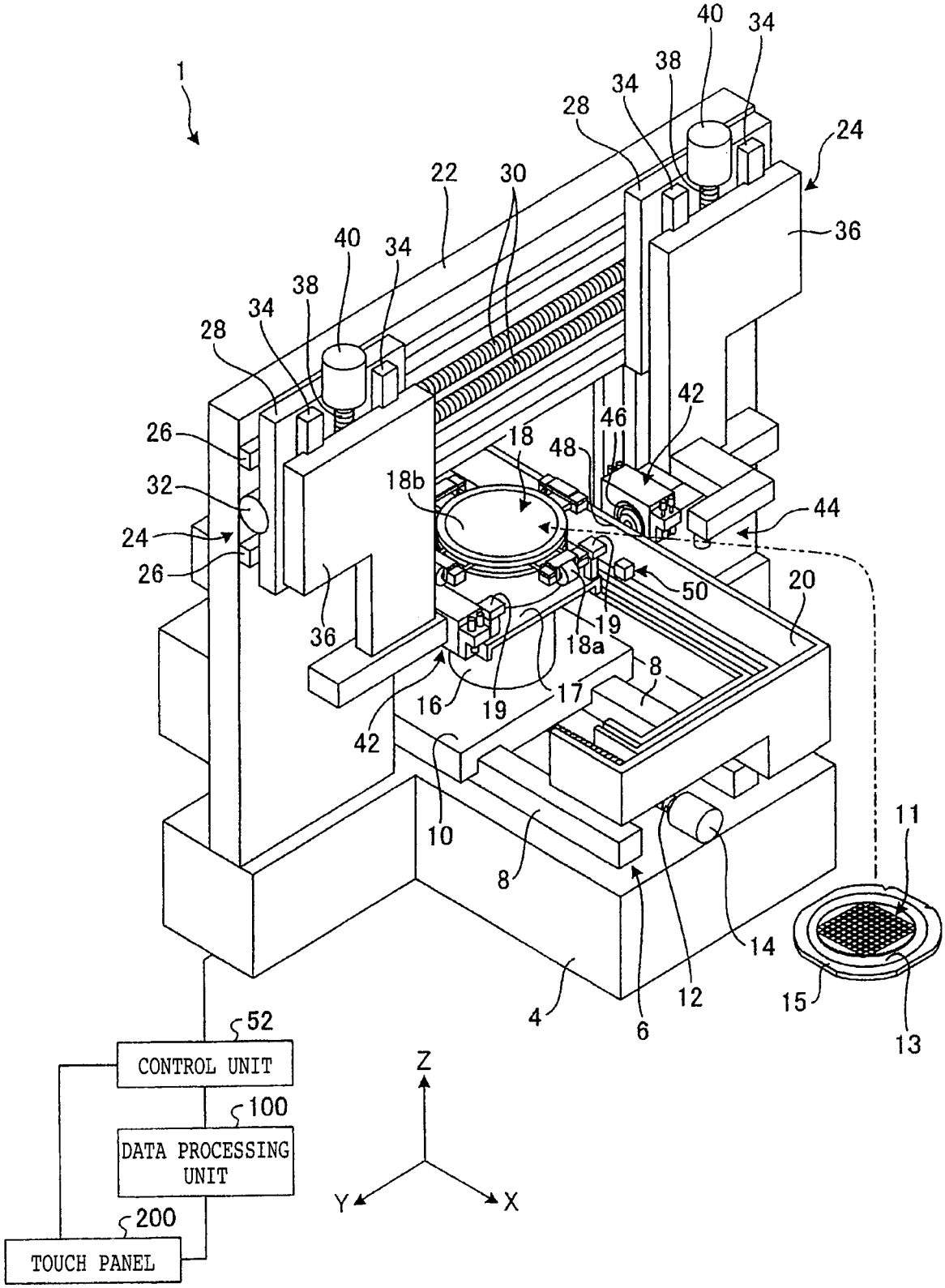
FIG. 1 is a schematic perspective view depicting the configuration of a processing apparatus according to a preferred embodiment of the present invention.

A preferred embodiment of the present invention will now be described in detail with reference to the drawings. The present invention is not limited to the preferred embodiment. Further, the components used in the preferred embodiment may include those that can be easily assumed by persons skilled in the art or substantially the same elements as those known in the art. Further, the configurations described below may be suitably combined. Further, the configurations may be variously omitted, replaced, or changed without departing from the scope of the present invention.

In the following preferred embodiment, an XYZ orthogonal coordinate system is set to describe a positional relation between the components with reference to the XYZ orthogonal coordinate system. A predetermined direction in a horizontal plane is defined as an X direction depicted by an arrow X in the drawings, and a direction perpendicular to the X direction in this horizontal plane is defined as a Y direction depicted by an arrow Y in the drawings. Further, a direction perpendicular to both the X direction and the Y direction is defined as a Z direction depicted by an arrow Z in the drawings. An XY plane defined by the X direction and the Y direction is parallel to a horizontal plane. The Z direction perpendicular to the XY plane is a vertical direction.

Figure 2:
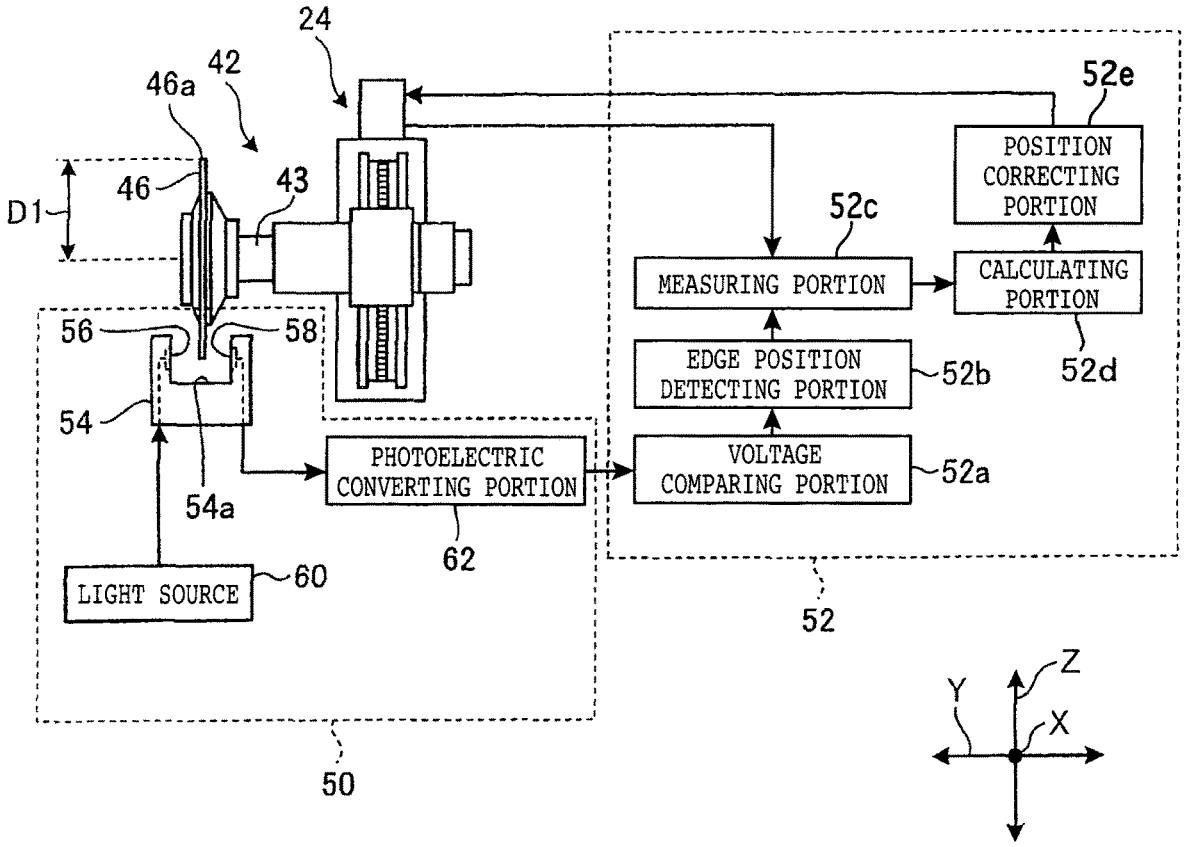
FIG. 2 is a schematic block diagram depicting the function of an essential part of the processing apparatus depicted in FIG. 1.

The configuration of a processing apparatus 1 according to the preferred embodiment will now be described with reference to the drawings. FIG. 1 is a schematic perspective view depicting the configuration of the processing apparatus 1. FIG. 2 is a schematic block diagram depicting the function of an essential part of the processing apparatus 1.

The processing apparatus 1 depicted in FIG. 1 is a cutting apparatus for cutting a workpiece 11. The workpiece 11 is a disk-shaped wafer such as a semiconductor wafer and an optical device wafer including a substrate formed of silicon, sapphire, or gallium arsenide, for example. The workpiece 11 has a front side (upper surface as viewed in FIG. 1) and a back side (lower surface as viewed in FIG. 1) opposite to the front side. A plurality of crossing division lines are formed on the front side of the workpiece 11 to thereby define a plurality of separate regions where a plurality of devices are respectively formed. A circular tape 13 is attached to the back side of the workpiece 11. The circular tape 13 has a diameter larger than that of the workpiece 11, and a central circular portion of the tape 13 is attached to the back side of the workpiece 11. A ring frame 15 is attached to a peripheral portion of the tape 13. Thus, the workpiece 11 is supported through the tape 13 to the ring frame 15.

In the case that the workpiece 11 includes a material that can absorb water to change characteristics, such as epoxy resin and green ceramic, the processing apparatus 1 performs a cutting operation in a dry condition where no cutting water is supplied (dry processing).

As depicted in FIG. 1, the processing apparatus 1 includes a base 4 on which various components are mounted. An X moving mechanism 6 is provided on the upper surface of the base 4. The X moving mechanism 6 includes a pair of X guide rails 8 parallel to the X direction (work feeding direction). An X movable table 10 is slidably mounted on the pair of X guide rails 8.

A nut portion (not depicted) is formed on the lower surface of the X movable table 10, and an X ball screw 12 parallel to the X guide rails 8 is threadedly engaged with this nut portion. An X pulse motor 14 for rotating the X ball screw 12 is connected to one end of the X ball screw 12. Accordingly, when the X ball screw 12 is rotated by the X pulse motor 14, the X movable table 10 is moved in the X direction along the X guide rails 8. The X moving mechanism 6 is provided with an X position measuring unit (not depicted) for measuring the X position of the X movable table 10 as the position in the X direction.

A table base 16 is provided on the upper surface of the X movable table 10. A circular chuck table 18 for holding the workpiece 11 is provided through a rectangular cover table 17 on the upper surface of the table base 16. A dressing board 19 is provided at one corner of the cover table 17. The dressing board 19 functions to shape a cutting blade 46 (to be hereinafter described) reduced in cutting performance due to loading or dulling, thereby removing cutting dust adhering to the cutting blade 46 to recover the cutting performance of the cutting blade 46. Thus, the operation of shaping the cutting blade 46 to thereby recover the cutting performance of the cutting blade 46 is called dressing. Further, four clamps 18*a* are provided on the outer circumference of the chuck table 18 so as to be arranged at equal intervals in the circumferential direction of the chuck table 18. The four clamps 18*a* function to fix the ring frame 15 supporting the workpiece 11 through the tape 13.

The chuck table 18 is connected to a motor (not depicted) as a rotational drive source. Accordingly, the chuck table 18 is rotatable about its vertical axis extending in the Z direction (cutter feeding direction). Further, when the X movable table 10 is moved in the X direction by the X moving mechanism 6, the chuck table 18 is moved (fed) in the X direction.

The chuck table 18 has an upper surface as a holding surface 18*b* for holding the workpiece 11. The holding surface 18*b* is substantially parallel to both the X direction and the Y direction (indexing direction). Accordingly, the holding surface 18*b* is substantially perpendicular to the Z direction. A suction passage (not depicted) is formed in the chuck table 18 and the table base 16, and the holding surface 18*b* is connected through this suction passage to a vacuum source (not depicted). Accordingly, the workpiece 11 is held under suction on the holding surface 18*b* by using a vacuum produced by the vacuum source. This vacuum is also used to fix the chuck table 18 to the table base 16. The dressing board 19 is supported on the upper surface of a base (not depicted), and the holding surface 18*b* is set at the same level as that of the upper surface of this base for supporting the dressing board 19.

A transfer mechanism (not depicted) for transferring the workpiece 11 to the chuck table 18 is provided in the vicinity of the chuck table 18. Further, a water case 20 is provided in the vicinity of the X movable table 10. In the case that a cutting water such as pure water is used in cutting the workpiece 11, the water case 20 functions to temporarily store a waste fluid including the cutting water used and cutting dust. The waste fluid stored in the water case 20 is discharged through a drain (not depicted) to the outside of the processing apparatus 1. In the dry processing using no cutting water, the waste fluid is not stored in the water case 20. The chuck table 18 is an example of the holding table in the present invention.

As depicted in FIG. 1, a double column type support structure 22 is provided on the upper surface of the base 4 so as to straddle the X moving mechanism 6. Two sets of cutting unit moving mechanisms 24 for respectively moving a pair of cutting units 42 are provided on the front surface of the support structure 22 at an upper portion thereof, in which each set of cutting unit moving mechanism 24 functions as an indexing unit for moving the corresponding cutting unit 42 in the Y direction and a cutter feeding unit for moving the corresponding cutting unit 42 in the Z direction. Both of the two sets of cutting unit moving mechanisms 24 include a pair of Y guide rails 26 substantially parallel to the Y direction as an indexing direction. The pair of Y guide rails 26 are provided on the front surface of the support structure 22. Each cutting unit moving mechanism 24 includes a Y movable plate 28 slidably mounted on the Y guide rails 26. Each cutting unit moving mechanism 24 is an example of the moving mechanism in the present invention, and each cutting unit 42 is an example of the processing means in the present invention.

A nut portion (not depicted) is formed on the back side (rear surface) of the Y movable plate 28 in each cutting unit moving mechanism 24, and a Y ball screw 30 substantially parallel to the Y guide rails 26 is threadedly engaged with this nut portion. A Y pulse motor 32 for rotating the Y ball screw 30 is connected to one end of the Y ball screw 30. Accordingly, when the Y ball screw 30 is rotated by the Y pulse motor 32, the Y movable plate 28 is moved in the Y direction along the Y guide rails 26.

A pair of Z guide rails 34 substantially parallel to the Z direction are provided on the front side (front surface) of the Y movable plate 28 in each cutting unit moving mechanism 24. A Z movable plate 36 is slidably mounted on the Z guide rails 34.

A nut portion (not depicted) is formed on the back side (rear surface) of the Z movable plate 36, and a Z ball screw 38 substantially parallel to the Z guide rails 34 is threadedly engaged with this nut portion. A Z pulse motor 40 for rotating the Z ball screw 38 is connected to one end of the Z ball screw 38. Accordingly, when the Z ball screw 38 is rotated by the Z pulse motor 40, the Z movable plate 36 is moved in the Z direction along the Z guide rails 34.

Each cutting unit moving mechanism 24 is provided with a Y position measuring unit (not depicted) for measuring the Y position of the Y movable plate 28 as the position in the Y direction. Further, each cutting unit moving mechanism 24 is provided with a Z position measuring unit (not depicted) for measuring the Z position of the Z movable plate 36 as the position in the Z direction.

A cutting unit 42 for cutting the workpiece 11 held on the chuck table 18 is fixed to the lower end of the Z movable plate 36 in each cutting unit moving mechanism 24. Further, a camera 44 as an imaging unit for imaging the workpiece 11 is provided adjacent to the cutting unit 42. In each cutting unit moving mechanism 24, the cutting unit 42 and the camera 44 are moved together in the Y direction (indexing direction) by moving the Y movable plate 28 in the Y direction, and the cutting unit 42 and the camera 44 are moved together in the Z direction (cutter feeding direction) by moving the Z movable plate 36 in the Z direction, in which the Z direction is perpendicular to the holding surface 18*b* of the chuck table 18.

The X position of each of the cutting unit 42 and the camera 44 with respect to the chuck table 18 is measured by the X position measuring unit mentioned above. The Y position of each of the cutting unit 42 and the camera 44 with respect to the chuck table 18 is measured by the Y position measuring unit mentioned above. The Z position of each of the cutting unit 42 and the camera 44 with respect to the chuck table 18 or the dressing board 19 is measured by the Z position measuring unit mentioned above.

Each cutting unit 42 includes a spindle 43 (see FIG. 3) having a rotation axis substantially parallel to the Y direction. An annular cutting blade 46 is mounted on the spindle 43 at one end portion thereof. A motor (not depicted) as a rotational drive source for rotating the spindle 43 is connected to the other end of the spindle 43. Accordingly, the cutting blade 46 is rotated by the torque output from this motor and transmitted through the spindle 43. The cutting blade 46 includes an annular cutting edge having a cutting area allowed to cut the workpiece 11. The cutting blade 46 is replaceably used according to the kind of the workpiece 11.

An edge position detecting unit 50 is provided below the cutting blade 46. The edge position detecting unit 50 functions to detect the position of the edge (lower end) of the cutting blade 46 in the Z direction. Further, a cutting water nozzle 48 is provided in the vicinity of the cutting blade 46. The cutting water nozzle 48 is used in the case of supplying a cutting water to the workpiece 11 and the cutting blade 46.

As depicted in FIG. 2, the edge position detecting unit 50 includes a base portion 54. The base portion 54 has a blade receiving portion 54*a* for receiving the lower end portion of the cutting blade 46. The blade receiving portion 54*a* is a cutout formed on the upper end surface of the base portion 54 in such a manner that the lower end portion of the cutting blade 46 is adapted to enter the cutout. The blade receiving portion 54*a* has a pair of inside surfaces opposed to each other in the Y direction. A light emitting portion 56 is provided on one of the inside surfaces of the blade receiving portion 54*a*, and a light receiving portion 58 is provided on the other inside surface of the blade receiving portion 54*a*. The light emitting portion 56 and the light receiving portion 58 constitute an optical sensor. Thus, the light emitting portion 56 and the light receiving portion 58 are opposed to each other with the blade receiving portion 54*a* interposed therebetween. A light source 60 is connected through an optical fiber or the like to the light emitting portion 56. A photoelectric converting portion 62 is connected through an optical fiber or the like to the light receiving portion 58. For example, the photoelectric converting portion 62 is constituted of one or more photoelectric conversion elements and functions to convert the quantity of light transmitted from the light receiving portion 58 into a voltage and then output the voltage.

The X moving mechanism 6, the chuck table 18, the transfer mechanism, each cutting unit moving mechanism 24, each cutting unit 42, the camera 44, and the edge position detecting unit 50 are all connected to a control unit 52. As depicted in FIG. 1, a data processing unit 100 and a touch panel 200 are also connected to the control unit 52. The control unit 52 functions to control each component mentioned above according to processing conditions in cutting the workpiece 11.

The control unit 52 is a computer capable of executing a computer program, in which the computer includes a computing unit having a microprocessor such as a central processing unit (CPU), a storing unit having a memory such as a read only memory (ROM) and a random access memory (RAM), and an input/output interface unit. As depicted in FIG. 2, the control unit 52 includes a voltage comparing portion 52*a*, an edge position detecting portion 52*b*, a measuring portion 52*c* (an example of the measuring means in the present invention), a calculating portion 52*d*, and a position correcting portion 52*e*.

The voltage comparing portion 52*a* functions to compare the voltage output from the photoelectric converting portion 62 with any reference voltage and then output the result of this comparison to the edge position detecting portion 52*b*. The edge position detecting portion 52*b* functions to detect the position of the circumferential edge (the lower end of the cutting edge) 46*a* of the cutting blade 46 according to the output from the voltage comparing portion 52*a*. More specifically, when the voltage output from the photoelectric converting portion 62 has reached the above reference voltage or less (i.e., when the light quantity from the light receiving portion 58 has reached a predetermined light quantity or less), the edge position detecting portion 52*b* detects the Z position of the cutting unit 42 as the position of the edge (lower end) 46*a* of the cutting blade 46.

The measuring portion 52*c* functions to measure the radius D1 of the cutting blade 46 according to the position of the edge (lower end) 46*a* of the cutting blade 46 as detected by the edge position detecting portion 52*b* and according to a signal from each cutting unit moving mechanism 24 (Z position measuring unit). Information regarding the radius D1 of the cutting blade 46 as measured by the measuring portion 52*c* and the position of the edge (lower end) 46*a* of the cutting blade 46 is transmitted to the calculating portion 52*d*.

The calculating portion 52*d* functions to calculate a correction amount for the Z position of the cutting blade 46 (the cutting unit 42) according to the radius D1 of the cutting blade 46 and the position of the edge 46*a* of the cutting blade 46 as informed from the measuring portion 52*c*. The correction amount for the Z position of the cutting blade 46 (the cutting unit 42) as calculated by the calculating portion 52*d* is transmitted to the position correcting portion 52*e*.

The position correcting portion 52*e* functions to correct the Z position of the cutting blade 46 (the cutting unit 42) according to the correction amount informed from the calculating portion 52*d*. In this manner, the edge (lower end) 46*a* of the cutting blade 46 is detected according to a change in light quantity received by the light receiving portion 58 when the cutting blade 46 enters the blade receiving portion 54*a*. This operation is called noncontact setup.

Figure 3:
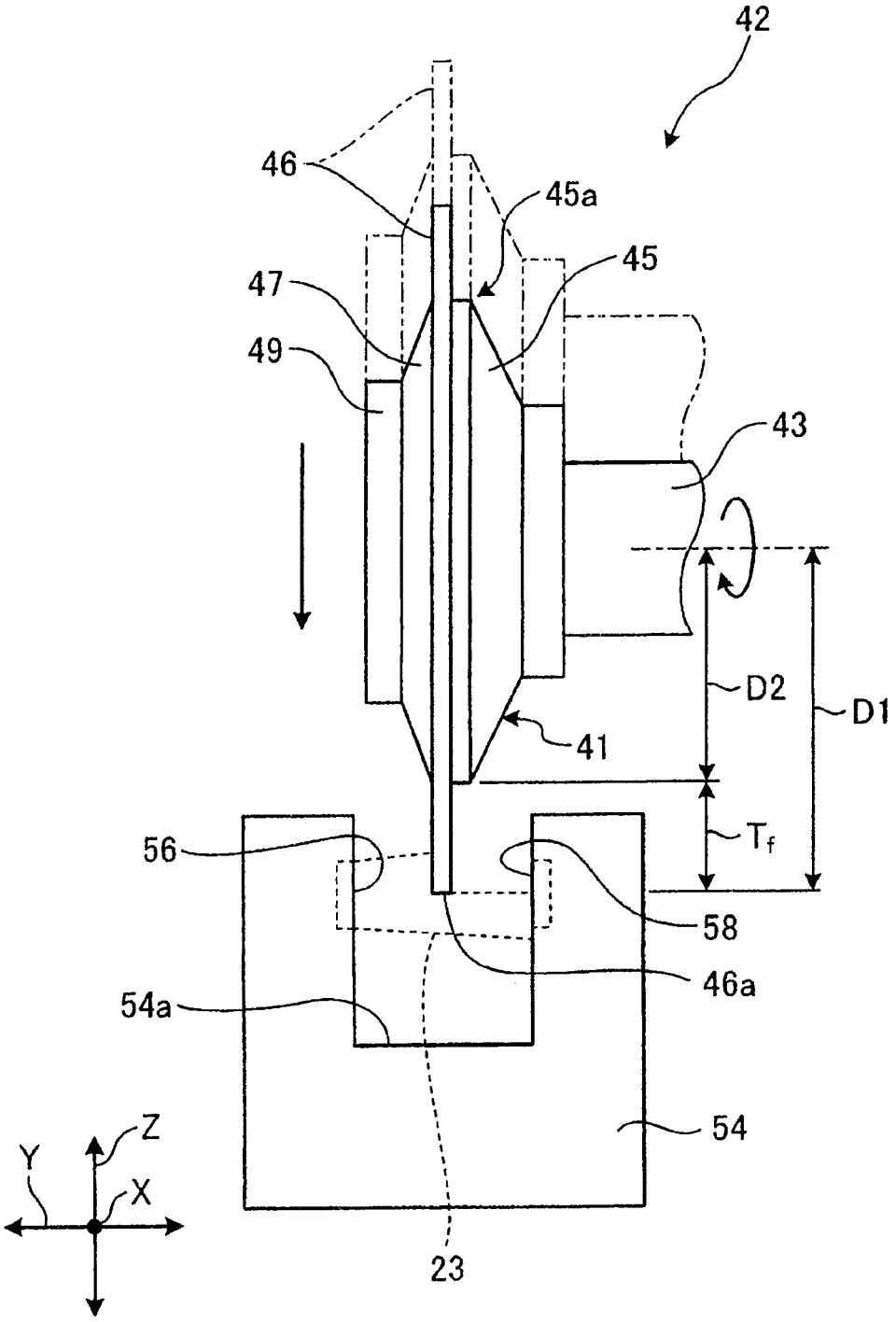
FIG. 3 is a schematic side view depicting a measuring method for an edge projection amount of a cutting blade according to the preferred embodiment.

In the preferred embodiment, the measuring portion 52*c* included in the control unit 52 can measure an edge projection amount of the cutting blade 46 by using this noncontact setup. FIG. 3 is a schematic side view depicting a measuring method for the edge projection amount according to the preferred embodiment.

As depicted in FIG. 3, in the measuring method for the edge projection amount, the cutting unit 42 is first positioned above the blade receiving portion 54*a* of the edge position detecting unit 50. Thereafter, the cutting unit 42 is lowered by operating the cutting unit moving mechanism 24 until the cutting blade 46 being rotated enters the blade receiving portion 54*a*. At this time, light 23 is applied from the light emitting portion 56 to the light receiving portion 58 in the edge position detecting unit 50. That is, the cutting unit 42 is lowered while the light 23 being applied. Accordingly, the light 23 being applied from the light emitting portion 56 to the light receiving portion 58 is partially blocked by the cutting blade 46, so that the light quantity received by the light receiving portion 58 becomes a predetermined threshold value or less. The reference voltage to be used as a threshold value in the voltage comparing portion 52*a* is set so as to correspond to this threshold value for the light quantity.

When the light quantity received by the light receiving portion 58 becomes the predetermined threshold value or less, the voltage output from the photoelectric converting portion 62 depicted in FIG. 2 becomes the reference voltage or less. When the voltage output from the photoelectric converting portion 62 becomes the reference voltage or less, the edge position detecting portion 52*b* detects the Z position of the cutting unit 42 as the position of the edge (lower end) 46*a* of the cutting blade 46.

As depicted in FIG. 3, the cutting blade 46 included in the cutting unit 42 is a so-called washer blade, and the cutting blade 46 is mounted through a mounting member 41 on the spindle 43. The cutting blade 46 is an annular blade formed by binding abrasive grains such as diamond abrasive grains with a bond such as electroformed/electrodeposited bond, metal bond, resin bond, and vitrified bond. The mounting member 41 includes an annular mount flange 45 fixed to the front end portion of the spindle 43, an annular pressure flange 47 opposed to the mount flange 45, and a fixing nut 49 threadedly engaged with the pressure flange 47. In mounting the cutting blade 46 on the spindle 43 by using the mounting member 41, the cutting blade 46 is sandwiched between the mount flange 45 and the pressure flange 47, and the fixing nut 49 is next tightened to the pressure flange 47. Thus, the cutting blade 46 is fixed between the mount flange 45 and the pressure flange 47. The mount flange 45 and the pressure flange 47 constituting the mounting member 41 have the same diameter (outer diameter) which is smaller than the diameter (outer diameter) of the cutting blade 46. Accordingly, the cutting blade 46 projects radially outward from the outer circumferential edges of the mount flange 45 and the pressure flange 47. The amount of projection of such a projecting portion of the cutting blade 46 is the edge projection amount.

The measuring portion 52*c* measures the radius D1 of the cutting blade 46 according to the position of the edge (lower end) 46*a* of the cutting blade 46 as detected by the edge position detecting portion 52*b* and according to the signal from the cutting unit moving mechanism 24. The radius D1 of the cutting blade 46 corresponds to the distance from the axis of the spindle 43 to the edge (lower end) 46*a* of the cutting blade 46. After measuring the radius D1 of the cutting blade 46, the measuring portion 52*c* reads out the radius D2 of the mount flange 45, the radius D2 being previously stored in the memory. The radius D2 of the mount flange 45 corresponds to the distance from the axis of the spindle 43 to the outer circumferential edge 45*a* of the mount flange 45. Thereafter, the measuring portion 52*c* determines the difference between the radius D1 of the cutting blade 46 and the radius D2 of the mount flange 45. Accordingly, the measuring portion 52*c* can measure the edge projection amount $T_f$ as this difference between the radius D1 and the radius D2. That is, the edge projection amount $T_f$ is the width of the cutting area of the cutting edge of the cutting blade 46, this cutting area projecting radially outward from the outer circumferential edge 45*a* of the mount flange 45. That is, the workpiece 11 can be cut by this cutting area. The edge projection amount $T_f$ is decreased with the use of the cutting blade 46 due to wearing of this cutting area.

The measurement of the edge projection amount by the edge position detecting unit 50 and the control unit 52 is performed by an operator every time a preset cutting distance is traveled by the cutting blade 46. The edge projection amount measured by the control unit 52 and the cutting distance at the time of measurement of the edge projection amount are transmitted to the data processing unit 100.

Figure 4:
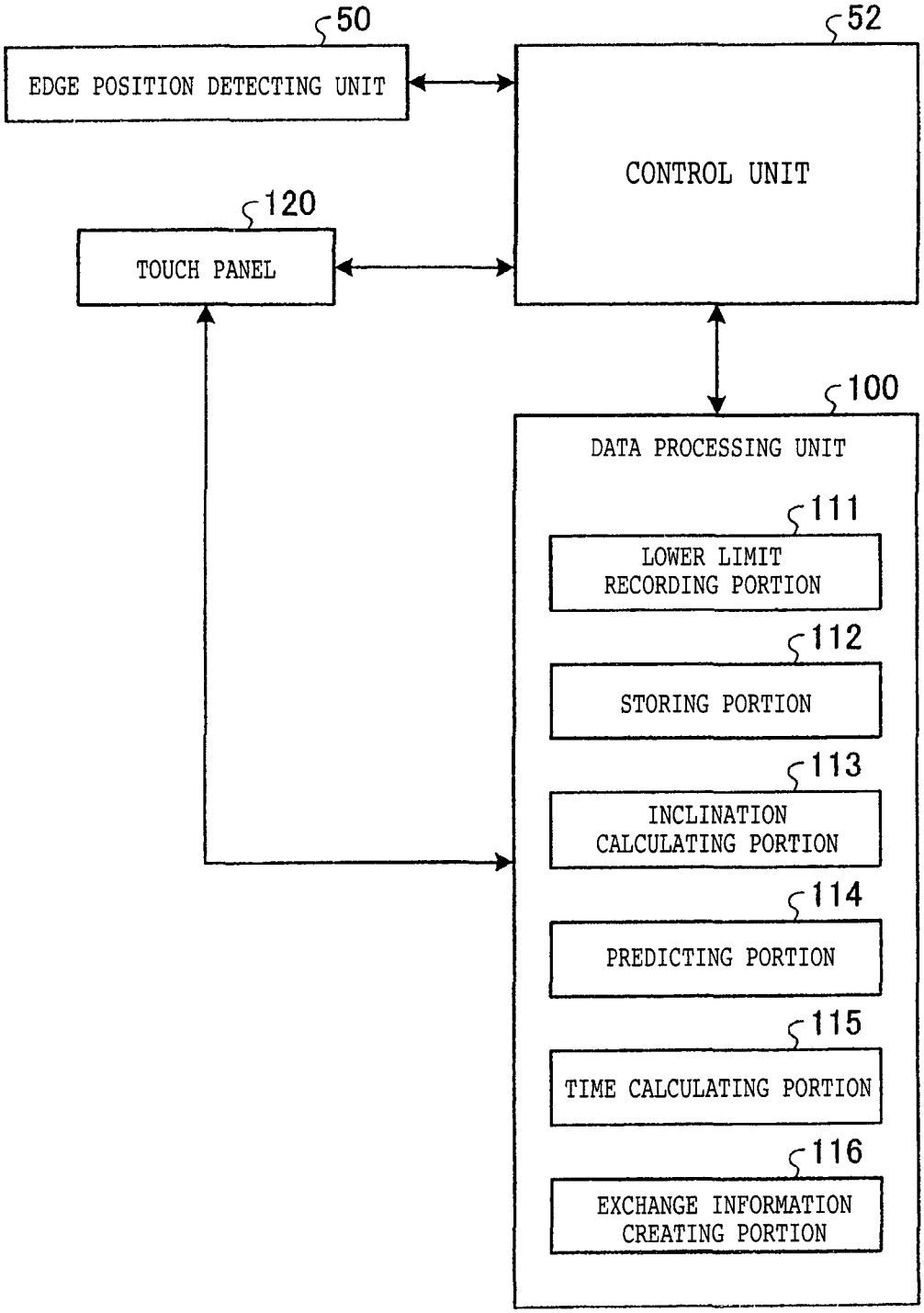
FIG. 4 is a schematic block diagram depicting functional components of a data processing unit according to the preferred embodiment.

The data processing unit 100 according to the preferred embodiment will now be described with reference to FIG. 4. FIG. 4 is a schematic block diagram depicting functional components of the data processing unit 100 according to the preferred embodiment. For example, the data processing unit 100 is a computer capable of executing a computer program, in which the computer includes a computing unit, a storing unit, and an input/output interface unit. The data processing unit 100 is an example of the data processing portion in the present invention.

The computing unit functions to compute according to the program stored in the storing unit, thereby executing various kinds of processing by the data processing unit 100. The computing unit includes a processor such as a CPU microprocessor, a microcomputer, a digital signal processor (DSP), and a system large scale integration (LSI).

The storing unit functions to store a program for realizing the function for various kinds of processing to be executed by the data processing unit 100 and also store data to be used for the processing by the program. The storing unit includes a nonvolatile or volatile semiconductor memory such as a RAM, a ROM, a flash memory, an erasable programmable read only memory (EPROM), and an electrically erasable programmable read only memory (EEPROM) (registered trademark). The storing unit may be used also as a temporary working area by the processor included in the computing unit in executing the commands described in the program. The program stored in the storing unit may be called also a program product having a processor readable and non-transitory recording medium including a plurality of commands for performing data processing that can be executed by the processor included in the computing unit.

As depicted in FIG. 4, the data processing unit 100 includes a lower limit recording portion 111, a storing portion 112, an inclination calculating portion 113, a predicting portion 114, a time calculating portion 115, and an exchange information creating portion 116.

The lower limit recording portion 111 functions to record a lower limit of the edge projection amount of the cutting blade 46. That is, the lower limit recording portion 111 functions to record an allowable limit of the edge projection amount of the cutting blade 46 for use in cutting the workpiece 11. FIG. 5 is a table depicting an example of the lower limit of the edge projection amount of the cutting blade 46. The lower limit recording portion 111 is an example of the lower limit recording portion in the present invention.

As depicted in FIG. 5, the lower limit recording portion 111 includes an item for a blade ID and an item for the lower limit of the edge projection amount and records data in the item for the lower limit of the edge projection amount in correspondence with data in the item for the blade ID. The lower limit of the edge projection amount is decided according to cutting conditions. For example, when the depth of cut in the workpiece 11 is 1.5 mm, the lower limit of the edge projection amount is decided to a value of 2.0 mm obtained by adding a predetermined allowance of 0.5 mm to 1.5 mm as the depth of cut.

The storing portion 112 functions to store the edge projection amount measured by the measuring portion 52*c* (the edge position detecting unit 50 and the control unit 52) in correspondence with the cutting distance traveled by the cutting blade 46 at the time of measurement of the edge projection amount. That is, the edge projection amount measured and the cutting distance are stored in a one-to-one correspondence manner as blade information. FIG. 6 is a table depicting an example of the blade information according to the preferred embodiment. The storing portion 112 is an example of the storing portion in the present invention.

As depicted in FIG. 6, the blade information to be stored by the storing portion 112 includes an item for the measured values for the edge projection amount and an item for the cutting distance, in which data in these items corresponds to each other. The storing portion 112 obtains the edge projection amount and the cutting distance from the control unit 52 (the measuring portion 52*c*) and then stores the edge projection amount and the cutting distance in a one-to-one correspondence manner.

Figure 7:
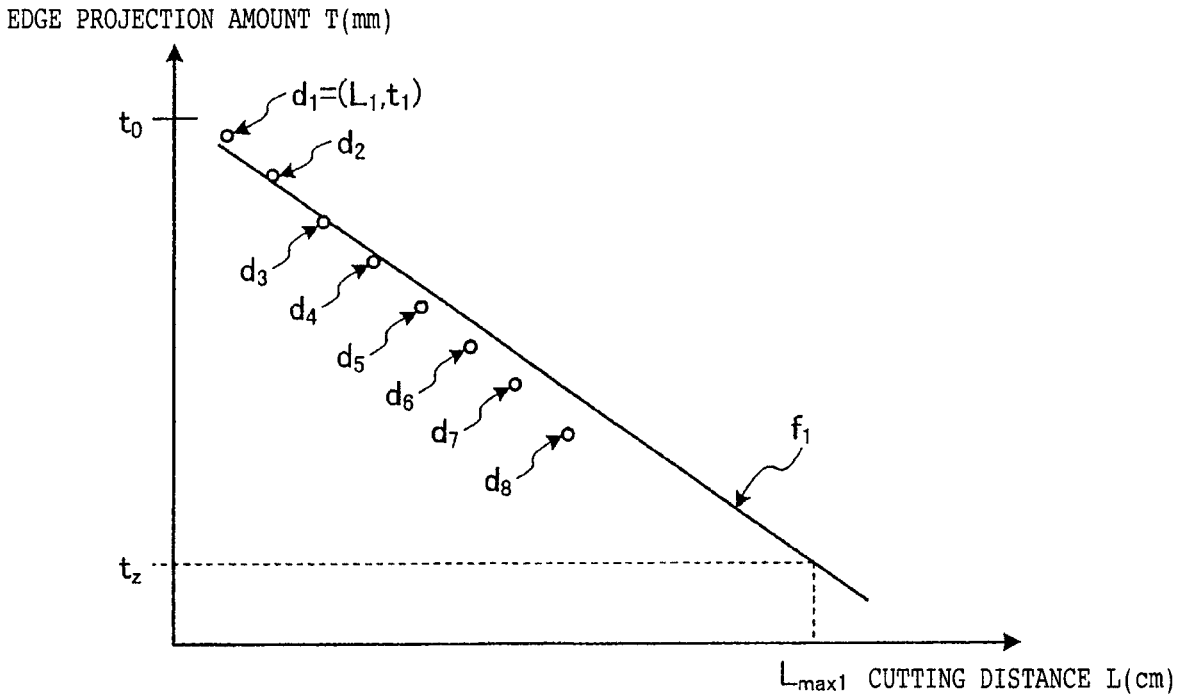
FIG. 7 is a graph depicting an example of the relation between the edge projection amount and a cutting distance traveled by the cutting blade according to the preferred embodiment.

The inclination calculating portion 113 functions to calculate an inclination such that the edge projection amount decreases with an increase in the cutting distance, from a plurality of pieces of blade information stored in the storing portion 112 by performing two or more measurements using the measuring portion 52*c* (the edge position detecting unit 50 and the control unit 52). FIG. 7 is a graph depicting an example of the relation between the edge projection amount and the cutting distance. The inclination calculating portion 113 is an example of the inclination calculating portion in the present invention. The inclination calculating portion 113 obtains a predetermined number of pieces of blade information $d_1$ to $d_8$ from the plurality of pieces of blade information stored in the storing portion 112 and then determines a linear function $f_1$ depicting the relation that the edge projection amount decreases with an increase in the cutting distance, by using a method of least squares, for example. The slope of the line depicting the linear function $f_1$ calculated by the inclination calculating portion 113 corresponds to the inclination that the edge projection amount decreases with an increase in the cutting distance.

The predicting portion 114 functions to calculate a maximum cutting distance at which the edge projection amount of the cutting blade 46 reaches a lower limit, from the slope calculated by the inclination calculating portion 113. More specifically, the predicting portion 114 uses the slope of the line depicting the linear function $f_1$ calculated by the inclination calculating portion 113, thereby calculating a cutting distance (maximum cutting distance $L_{max1}$) at which the edge projection amount of the cutting blade 46 reaches a lower limit $t_z$. That is, the maximum cutting distance $L_{max1}$ corresponds to the lower limit $t_z$ of the edge projection amount. The predicting portion 114 is an example of the predicting portion in the present invention.

The time calculating portion 115 functions to calculate the time required for cutting of the workpiece 11 by a predetermined distance to be traveled by the cutting blade 46, from the cutting conditions and the size of the workpiece 11. For example, the time calculating portion 115 may calculate a remaining cutting distance up to the maximum cutting distance calculated by the predicting portion 114 and then calculate a remaining time period until the maximum cutting distance is reached, according to the above-calculated remaining cutting distance and a cutting speed. The time calculating portion 115 is an example of the time calculating portion in the present invention.

The exchange information creating portion 116 functions to create blade exchange information as a guide for exchange timing with which the cutting blade 46 is to be exchanged. For example, the exchange information creating portion 116 may create the blade exchange information including at least one of the maximum cutting distance calculated by the predicting portion 114, the remaining time period until the maximum cutting distance is reached as calculated by the time calculating portion 115, and the number of workpieces 11 that can be cut until the maximum cutting distance is reached. The remaining time period until the maximum cutting distance is reached may be converted into the time when the maximum cutting distance is reached. The remaining time period until the maximum cutting distance is reached may be converted into the number of workpieces 11 that can be cut until the maximum cutting distance is reached. The number of workpieces 11 that can be cut until the maximum cutting distance is reached includes the number of wafers that can be cut or the number of cassettes storing the wafers that can be cut. That is, the remaining time period until the maximum cutting distance is reached can be converted into the number of workpieces 11 that can be cut until the maximum cutting distance is reached, according to information regarding the number of workpieces 11 that can be cut per unit time. The blade exchange information created by the exchange information creating portion 116 is sent to the touch panel 200.

The touch panel 200 functions to display various kinds of information relating to the processing apparatus 1. The touch panel 200 is adapted to receive from the operator various kinds of operation inputs relating to the processing apparatus 1, such as an input for setting of the cutting conditions. For example, the touch panel 200 displays the blade exchange information sent from the data processing unit 100. The touch panel 200 is an example of the displaying means in the present invention.

Figure 8:
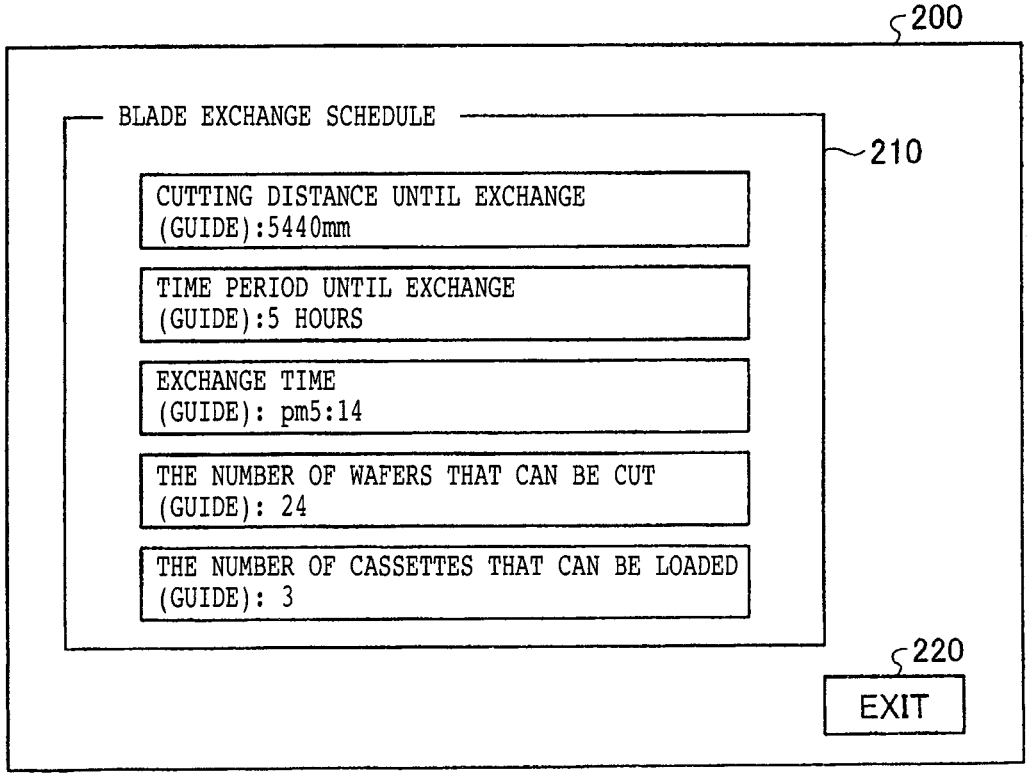
FIG. 8 is a block diagram depicting an example of blade exchange information displayed on a touch panel according to the preferred embodiment.

FIG. 8 is a block diagram depicting an example of the blade exchange information displayed on the touch panel 200. As depicted in FIG. 8, the touch panel 200 includes a blade exchange information displaying area 210 for displaying the blade exchange information and an EXIT button 220 for ending the display of the blade exchange information. The blade exchange information displaying area 210 displays the information regarding the cutting distance until exchange, the time period until exchange, the exchange time, the number of wafers that can be cut, and the number of cassettes that can be loaded. While the blade exchange information displaying area 210 displays all of the cutting distance until exchange, the time period until exchange, the exchange time, the number of wafers that can be cut, and the number of cassettes that can be loaded as depicted in FIG. 8, at least one of these items may be actually displayed in the blade exchange information displaying area 210. The blade exchange information to be displayed in the blade exchange information displaying area 210 may be changed according to setting by the operator.

Figure 9:
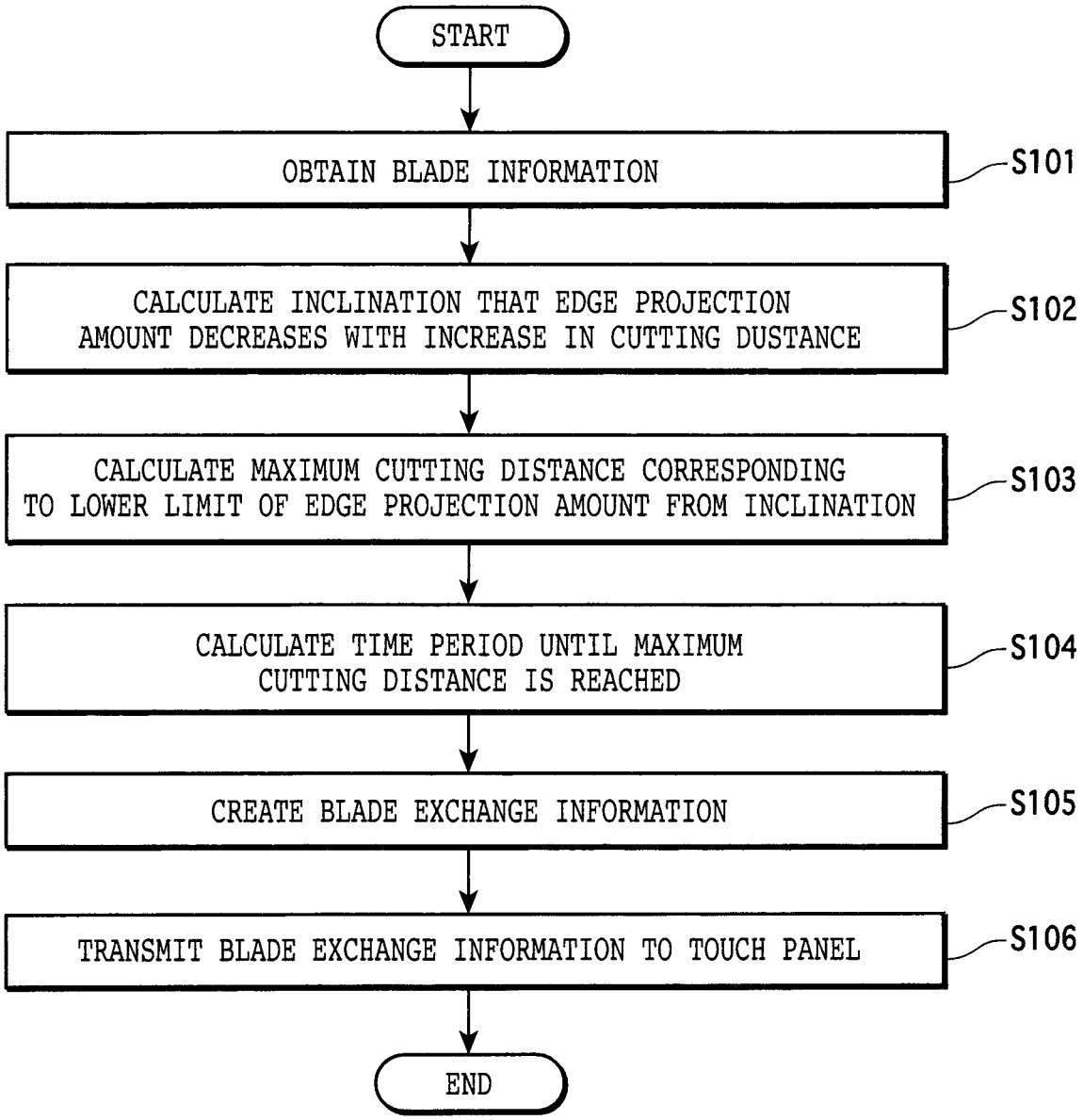
FIG. 9 is a flowchart depicting the procedure of information processing by the data processing unit according to the preferred embodiment.

The procedure of information processing by the data processing unit 100 will now be described with reference to FIG. 9. FIG. 9 is a flowchart depicting the procedure of information processing by the data processing unit 100. The information processing depicted in FIG. 9 is performed by the above-mentioned portions of the data processing unit 100. As depicted in FIG. 9, the inclination calculating portion 113 obtains a predetermined number of pieces of blade information from the plurality of pieces of blade information stored in the storing portion 112 (step S101).

Thereafter, the inclination calculating portion 113 calculates the inclination that the edge projection amount of the cutting blade 46 decreases with an increase in the cutting distance traveled by the cutting blade 46, from the blade information obtained in step S101 (step S102). More specifically, the inclination calculating portion 113 determines a linear function depicting the relation between the cutting distance increasing and the edge projection amount decreasing, from the blade information obtained from the storing portion 112, by using a method of least squares, for example.

Thereafter, the predicting portion 114 calculates a maximum cutting distance corresponding to a lower limit of the edge projection amount, from the inclination calculated by the inclination calculating portion 113 (step S103). More specifically, the predicting portion 114 calculates the cutting distance corresponding to the lower limit of the edge projection amount, by using the linear function determined by the inclination calculating portion 113 (i.e., by using the slope of the line depicting the linear function). Thereafter, the time calculating portion 115 calculates the time period until the maximum cutting distance calculated by the predicting portion 114 is reached (step S104).

Thereafter, the exchange information creating portion 116 creates blade exchange information according to the maximum cutting distance and the time period until the maximum cutting distance is reached (step S105), and then transmits the blade exchange information created above to the touch panel 200 (step S106). In this manner, the processing depicted in FIG. 9 is finished. In the case that the maximum cutting distance is transmitted to the touch panel 200 and displayed on the touch panel 200, the creation of the blade exchange information may be omitted.

As described above, the processing apparatus 1 according to the preferred embodiment includes the chuck table 18 for holding the workpiece 11, the cutting blade 46 mounted on the rotatable spindle 43 and including a cutting edge having a cutting area allowed to cut the workpiece 11, the measuring portion 52*c* for measuring the edge projection amount of the cutting blade 46 at a predetermined frequency, and the data processing unit 100. The data processing unit 100 includes the lower limit recording portion 111, the storing portion 112, the inclination calculating portion 113, and the predicting portion 114. The lower limit recording portion 111 records the lower limit of the edge projection amount of the cutting blade 46. The storing portion 112 stores the blade information composed of the edge projection amount measured by the measuring portion 52*c* and the cutting distance traveled by the cutting blade 46 at the time of measurement of the edge projection amount, in which the edge projection amount and the cutting distance are stored in a one-to-one correspondence manner. The inclination calculating portion 113 calculates the inclination such that the edge projection amount decreases with an increase in the cutting distance, from a plurality of pieces of blade information stored in the storing portion 112 by performing two or more measurements using the measuring portion 52*c*. The predicting portion 114 calculates a maximum cutting distance corresponding to the lower limit of the edge projection amount from the inclination calculated above.

Accordingly, the processing apparatus 1 according to the preferred embodiment can predict the maximum cutting distance to be traveled by the cutting blade 46 and can inform the operator of a guide for the timing of exchange of the cutting blade 46 in advance. As a result, the workability of the operator can be improved.

Further, the data processing unit 100 further includes the time calculating portion 115 for calculating the time required for cutting of the workpiece 11 by a predetermined distance to be traveled by the cutting blade 46, from cutting conditions and the size of the workpiece 11. Accordingly, the processing apparatus 1 according to the preferred embodiment can predict the time period until the maximum cutting distance to be traveled by the cutting blade 46 is reached and can inform the operator of a guide for the timing of exchange of the cutting blade 46 in advance. As a result, the workability of the operator can be improved.

Further, the processing apparatus 1 according to the preferred embodiment further includes the touch panel 200 for displaying blade exchange information as the timing of exchange of the cutting blade 46. The blade exchange information includes at least one of the cutting distance until the maximum cutting distance is reached, the time period until the maximum cutting distance is reached, the time when the maximum cutting distance is reached, and the number of workpieces 11 that can be cut until the maximum cutting distance is reached.

Accordingly, the processing apparatus 1 according to the preferred embodiment can provide various kinds of information to the operator as a guide for the timing of blade exchange. As a result, the workability of the operator can be improved.

As a modification, the processing apparatus 1 may further include an operation selecting window (not depicted) for operating a control unit included in another processing apparatus 1. With this configuration, the operator can operate the other processing apparatus 1 from the processing apparatus 1, thereby improving the workability.

Modifications of the Preferred Embodiment

Figure 10:
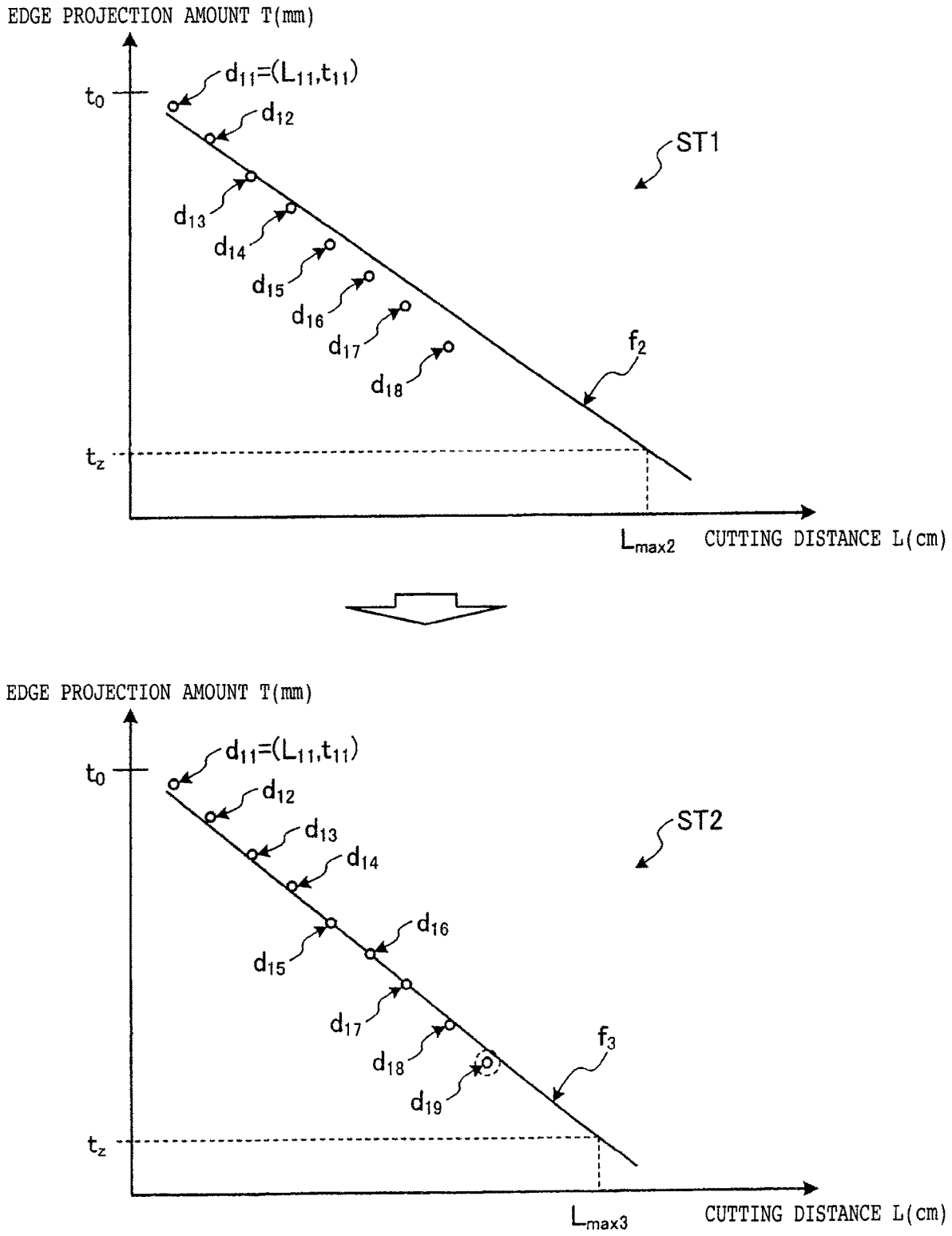
FIG. 10 is a graph depicting the relation between the edge projection amount and the cutting distance according to a modification of the preferred embodiment.

The inclination calculating portion 113 of the data processing unit 100 may perform recalculation of the inclination every time the measuring portion 52*c* measures the edge projection amount of the cutting blade 46. FIG. 10 is a graph depicting the relation between the edge projection amount and the cutting distance according to a modification of the preferred embodiment.

The inclination calculating portion 113 calculates the inclination (linear function $f_2$) depicting the relation between the cutting distance increasing and the edge projection amount decreasing, from blade information $d_{11}$ to $d_{18}$ stored in the storing portion 112. The predicting portion 114 determines a maximum cutting distance ($L_{max2}$) corresponding to the lower limit $t_z$ of the edge projection amount of the cutting blade 46, from the inclination (linear function $f_2$) calculated by the inclination calculating portion 113 (ST1 in FIG. 10).

Thereafter, the measurement of the edge projection amount is performed again by the measuring portion 52*c*, and new blade information $d_{19}$ is stored into the storing portion 112. Then, the inclination calculating portion 113 obtains blade information $d_{11}$ to $d_{19}$ including the new blade information dig from the storing portion 112 and next calculates the inclination (linear function $f_3$) depicting the relation between the cutting distance increasing and the edge projection amount decreasing, from the blade information $d_{11}$ to $d_{19}$. Thereafter, the predicting portion 114 determines a maximum cutting distance ($L_{max3}$) corresponding to the lower limit $t_z$ of the edge projection amount of the cutting blade 46, from the inclination (linear function $f_3$) calculated by the inclination calculating portion 113 (ST2 in FIG. 10).

In general, the edge projection amount of the cutting blade 46 decreases with an increase in wearing amount of the cutting blade 46. That is, the outer diameter of the cutting blade 46 decreases (i.e., the outer circumference of the cutting blade 46 becomes shorter) with an increase in wearing amount of the cutting blade 46. Thus, the cutting amount of the cutting blade 46 (i.e., the amount of the workpiece 11 to be cut by the cutting blade 46) is increased and a wearing rate is also increased. Accordingly, it is estimated that the inclination (e.g., the slope of the line depicting the linear function $f_3$) calculated by the inclination calculating portion 113 in the case of adding the new blade information (e.g., the blade information $d_{19}$) becomes steeper than the previous inclination (e.g., the slope of the line depicting the linear function $f_2$). As a result, it is estimated that the maximum cutting distance (e.g., $L_{max3}$) based on the inclination calculated in the case of adding the new blade information becomes shorter than the previous maximum cutting distance (e.g., $L_{max2}$).

In consideration of this estimation, the inclination calculating portion 113 in the data processing unit 100 performs recalculation of the inclination (linear function) every time the measuring portion 52*c* measures the edge projection amount. Accordingly, the processing apparatus 1 can improve the accuracy of calculation of the maximum cutting distance of the cutting blade 46.

As another modification, in performing the recalculation of the inclination (linear function) by the data processing unit 100, a predetermined number of pieces of blade information before the new blade information may be obtained rather than using all pieces of the blade information including the new blade information. For example, in the case that the number of pieces of blade information to be obtained is set to "8" in the example of FIG. 10, the inclination calculating portion 113 obtains blade information $d_{12}$ to $d_{19}$ from the storing portion 112 and next calculates the inclination depicting the relation between the cutting distance increasing and the edge projection amount decreasing, from the blade information $d_{12}$ to $d_{19}$.

As another modification, every time the recalculation of the inclination (linear function) is performed, the data processing unit 100 may recalculate a maximum cutting distance and the time period until the maximum cutting distance is reached, thereby creating new blade exchange information and displaying this new blade exchange information on the touch panel 200.

Figure 11:
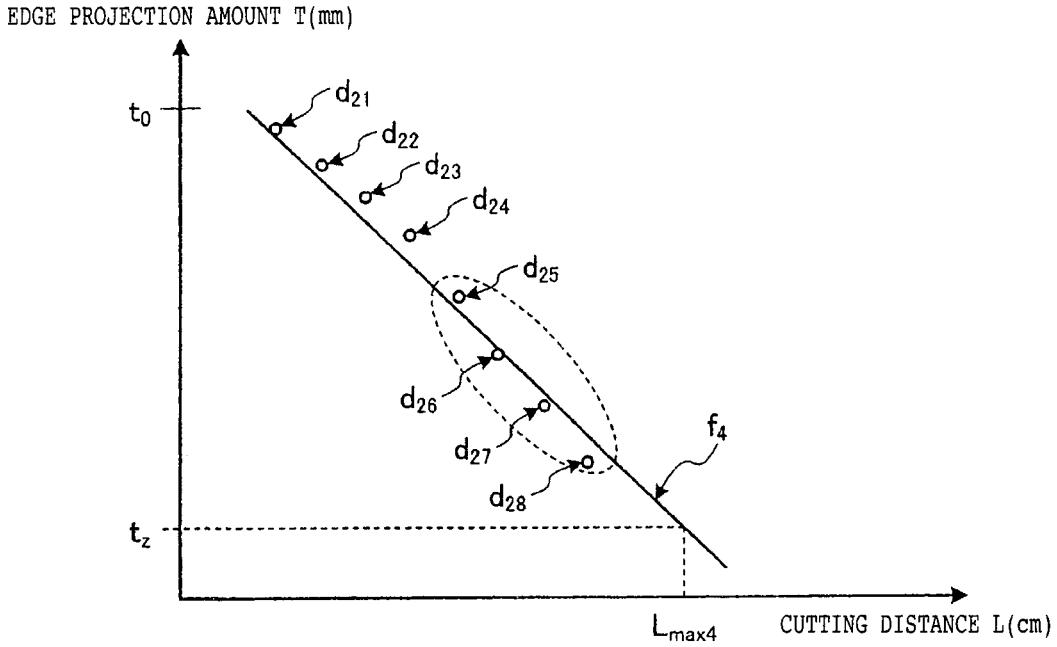
FIG. 11 is a graph depicting the relation between the edge projection amount and the cutting distance according to another modification of the preferred embodiment.

As another modification, the inclination calculating portion 113 in the data processing unit 100 may extract a last half portion of the blade information from the plurality of pieces of blade information stored in time sequence in the storing portion 112, and next calculate the inclination (linear function) from the last half portion of the blade information, thereby determining a maximum cutting distance. FIG. 11 is a graph depicting the relation between the edge projection amount and the cutting distance according to the modification.

As depicted in FIG. 11, a plurality of pieces of blade information $d_{21}$ to $d_{28}$ are stored in the storing portion 112. The inclination calculating portion 113 extracts a last half portion $d_{25}$ to $d_{28}$ from the blade information $d_{21}$ to $d_{28}$. Thereafter, the inclination calculating portion 113 calculates the inclination (linear function $f_4$) depicting the relation between the cutting distance increasing and the edge projection amount decreasing, from the blade information $d_{25}$ to $d_{28}$. Thereafter, the predicting portion 114 calculates a maximum cutting distance ($L_{max4}$) corresponding to the lower limit $t_z$ of the edge projection amount of the cutting blade 46, from the inclination (the slope of the line depicting the linear function $f_4$) calculated by the inclination calculating portion 113.

In this manner, the data processing unit 100 calculates the inclination (e.g., the slope of the line depicting the linear function $f_4$) from a predetermined number of pieces of blade information as a last half portion of the blade information stored in the storing portion 112 and then determines the maximum cutting distance (e.g., $L_{max4}$) corresponding to the lower limit $t_z$ of the edge projection amount of the cutting blade 46. Accordingly, the processing apparatus 1 can derive the inclination depicting the relation between the cutting distance increasing and the edge projection amount decreasing, by using a minimum number of data samples extracted from a plurality of pieces of blade information stored in time sequence. As a result, the accuracy of calculation of the maximum cutting distance of the cutting blade 46 can be improved.

Figure 12:
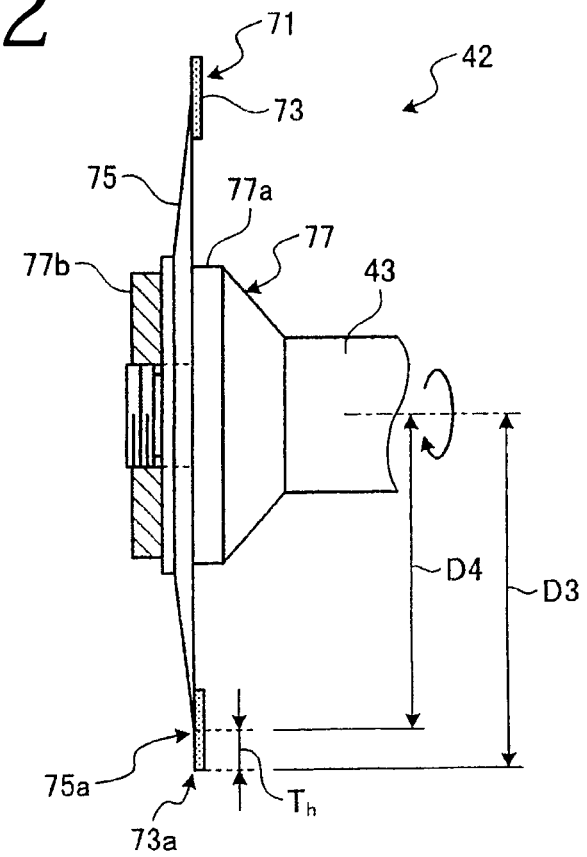
FIG. 12 is a side view of a cutting blade according to a further modification of the preferred embodiment.

While the cutting blade 46 included in the cutting unit 42 in the preferred embodiment is a so-called washer blade, the present invention is not limited to this configuration. That is, the cutting blade usable in the present invention may be a so-called hub blade. In this case, the processing apparatus 1 can also measure the edge projection amount of this hub blade in a manner similar to that for the cutting blade 46 as a washer blade. Further, the data processing unit 100 can create blade exchange information for such a cutting blade as a hub blade in a manner similar to that for the cutting blade 46 as a washer blade and then provide this blade exchange information to the operator. FIG. 12 is a side view of such a cutting blade as a hub blade according to the modification.

As depicted in FIG. 12, the cutting unit 42 includes a cutting blade 71 as a so-called hub blade. The cutting blade 71 is constituted of a blade portion 73 and a hub portion 75 integrated with each other. The blade portion 73 is an annular cutting wheel having a very small thickness. The blade portion 73 is an annular blade formed by binding abrasive grains such as diamond abrasive grains with an electroformed/electrodeposited bond. The blade portion 73 projects radially outward from the outer circumferential edge of the hub portion 75. The hub portion 75 is an annular plate-shaped member. The cutting blade 71 is mounted on the spindle 43 through a mounting member 77. The mounting member 77 includes a mount flange 77*a* fixed to the front end portion of the spindle 43 and a fixing nut 77*b* threadedly engaged with the mount flange 77*a*. In mounting the cutting blade 71 to the spindle 43 by using the mounting member 77, the hub portion 75 of the cutting blade 71 is sandwiched between the mount flange 77*a* and the fixing nut 77*b*, and the fixing nut 77*b* is next tightened to the mount flange 77*a*, thereby fixing the cutting blade 71 to the spindle 43.

The measuring portion 52*c* measures the radius D3 of the cutting blade 71 according to the position of the edge (lower end) 73*a* of the blade portion 73 of the cutting blade 71 as detected by the edge position detecting portion 52*b* and according to the signal from the cutting unit moving mechanism 24. The radius D3 of the cutting blade 71 corresponds to the distance from the axis of the spindle 43 to the edge (lower end) 73*a* of the blade portion 73 of the cutting blade 71. After measuring the radius D3 of the cutting blade 71, the measuring portion 52*c* reads out the radius D4 of the hub portion 75, the radius D4 being previously stored in the memory. The radius D4 of the hub portion 75 corresponds to the distance from the axis of the spindle 43 to the outer circumferential edge 75*a* of the hub portion 75. The measuring portion 52*c* next determines a difference between the radius D3 of the cutting blade 71 and the radius D4 of the hub portion 75. This difference corresponds to an edge projection amount $T_h$. Thus, the measuring portion 52*c* can measure the edge projection amount $T_h$ as the width of a cutting area of the cutting edge of the cutting blade 71, the cutting area projecting radially outward from the outer circumferential edge 75*a* of the hub portion 75.

Thereafter, the inclination calculating portion 113 in the data processing unit 100 calculates the inclination (the slope of a line depicting a linear function) depicting the relation between the cutting distance increasing and the edge projection amount decreasing, according to the edge projection amount of the cutting blade 71 as measured by the measuring portion 52*c*. Thereafter, the predicting portion 114 in the data processing unit 100 determines a maximum cutting distance corresponding to the lower limit of the edge projection amount of the cutting blade 71, from the inclination (the slope of the line depicting the linear function) as calculated above. Thereafter, blade exchange information is created by using this maximum cutting distance and then displayed on the touch panel 200. That is, the blade exchange information is provided to the operator.

Other Preferred Embodiments

The processing apparatus 1 according to the present invention is not limited to the above preferred embodiment, but various modifications may be made without departing from the scope of the present invention. For example, the processing by the data processing unit 100 included in the processing apparatus 1 according to the present invention may be performed by an information processing apparatus such as a server adapted to be connected through a communication network to the processing apparatus 1.

Each component of the processing apparatus 1 is merely functional and conceptual, and it is not always necessary to configure each component physically as depicted in the drawings. That is, a specific embodiment of dispersion and unification in the processing apparatus 1 is not limited to that depicted in the drawings, but the whole or part of the processing apparatus 1 may be dispersed or unified functionally or physically in any unit according to various loads or use conditions. For example, the inclination calculating portion 113, the predicting portion 114, the time calculating portion 115, and the exchange information creating portion 116 in the data processing unit 100 may be suitably united functionally or physically according to the content of information processing. Further, the control unit 52 and the data processing unit 100 may be united functionally or physically. For example, the processing function to be realized by the data processing unit 100 may be incorporated into the control unit 52.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A processing apparatus comprising:

a holding table for holding a workpiece;

a spindle adapted to be rotated;

a cutting blade mounted on the spindle, the cutting blade having a cutting edge for cutting the workpiece held on the holding table;

measuring means for measuring an edge projection amount of the cutting edge at a predetermined frequency; and a data processing unit, wherein the data processing unit includes a plurality of functional components including:

a lower limit recording portion for recording a lower limit of the edge projection amount of the cutting edge as an allowable limit for use of the cutting blade, a storing portion for storing blade information including the edge projection amount measured by the measuring means and a cutting distance traveled by the cutting blade at the time of measurement of the edge projection amount, the edge projection amount and the cutting distance being obtained from two or more measurements and being stored in a one-to-one correspondence manner, an inclination calculating portion for calculating an inclination indicating a decrease in the edge projection amount with an increase in the cutting distance, from the blade information stored in the storing portion, and a predicting portion for calculating a maximum cutting distance corresponding to the lower limit of the edge projection amount from the inclination calculated by the inclination calculating portion.

2. The processing apparatus according to claim 1, wherein the inclination calculating portion performs recalculation of the inclination every time the measuring means measures the edge projection amount of the cutting blade.

3. The processing apparatus according to claim 1, wherein the functional components of the data processing unit further includes a time calculating portion for calculating time required for cutting of the workpiece by a predetermined distance to be traveled by the cutting blade, from cutting conditions and size of the workpiece.

4. The processing apparatus according to claim 1, further comprising:

displaying means for displaying blade exchange information as timing of exchange of the cutting blade, wherein the blade exchange information includes at least one of the cutting distance until the maximum cutting distance is reached, a time period until the maximum cutting distance is reached, time when the maximum cutting distance is reaches and a number of workpieces that can be cut until the maximum cutting distance is reached.

* * * * *